United States Patent [19]

Becker

[11] 4,221,079

[45] Sep. 9, 1980

[54] WINDOW LIFTING ARRANGEMENT FOR A CURVED WINDOW PANE

[75] Inventor: Herbert Becker, Coburg-Neuses, Fed. Rep. of Germany

[73] Assignee: Metallwerke Max Brose GmbH & Co., Coburg, Fed. Rep. of Germany

[21] Appl. No.: 935,898

[22] Filed: Aug. 22, 1978

[30] Foreign Application Priority Data

Sep. 2, 1977 [DE] Fed. Rep. of Germany ..... 2739633

[51] Int. Cl.[2] ..... E05F 11/44

[52] U.S. Cl. ..... 49/351; 49/227; 49/40

[58] Field of Search ..... 49/351, 349, 350, 348, 49/227, 40, 375

[56] References Cited

U.S. PATENT DOCUMENTS

| | | | |
|---|---|---|---|
| 2,193,657 | 3/1940 | Sneed | 49/351 |
| 2,296,811 | 9/1942 | Devereaux | 49/350 |
| 2,772,901 | 12/1956 | Roethel | 49/350 X |
| 2,934,785 | 5/1960 | Heuer | 49/351 X |
| 3,816,962 | 6/1974 | Ladd et al. | 49/351 X |
| 3,888,047 | 6/1975 | Chikaraishi | 49/351 |

*Primary Examiner*—Philip C. Kannan

*Attorney, Agent, or Firm*—Toren, McGeady and Stanger

[57] ABSTRACT

A window lifting arrangement for an automotive vehicle and the like includes a support which defines the axes x, y, z of a system of rectangular coordinates. A window pane is mounted for movement relative to the support, the movement having a principal component in the direction of the y-axis, the pane and its direction of movement being arcuate about an axis of curvature transverse to the y-axis. A guide rail elongated in the direction of the z-axis is secured to the pane. An operating arm is mounted on the support for angular movement about a pivot axis and has a free end drivingly connected to the guide rail for movement of the free end longitudinally of the guide rail. The pivot axis is inclined relative to the plane defined by the y- and x-axes at a small acute angle, and preferably relative to a plane defined by the x- and y-axes at another small acute angle.

8 Claims, 7 Drawing Figures

WINDOW LIFTING ARRANGEMENT FOR A CURVED WINDOW PANE

This invention relates to window arrangements of a type frequently encountered in automotive vehicles, and particularly to a window arrangement including a curved window pane and a lifting arrangement for moving the window pane toward and away from a closed position.

A lifting arrangement known from the German Utility Model No. 1,990,738 operates a window pane curved about an axis of curvature transverse to the principal component of its direction of opening and closing movement. A guide rail fastened near the lower horizontal edge of the pane movably receives the free end of a pivotally mounted operating arm. Means are provided for guiding the free end of the operating arm, when released from the guide rail, in a path curved in the same sense as the path of the point of engagement of the arm with the guide rail, the latter path being curved because of the curvature of the pane. When suitably dimensioned, the known device permits the two aforementioned paths of the free end of the operating arm and of the window pane with the attached guide rail to be brought so closely together as to reduce stresses in the lifting arrangement to a minimum. The known arrangement, however, is ineffective when the pane is also inclined relative to a certain direction, particularly the vertical.

It is a primary object of this invention to avoid stresses due to divergent paths followed by the fastened and the released free end of an operating arm in a window arrangement of the general type described even where the known aforedescribed arrangement fails in this respect.

With this object and others in view, as will hereinafter become apparent, the invention provides a window lifting arrangement for an automotive vehicle and the like which includes a normally fixed support defining axes x, y, z of a system of rectangular coordinates and is suitable for raising and lowering a window pane mounted for arcuate movement relative to the support, the movement having a principal component in the direction of the y-axis, the pane and its direction of movement being arcuate about an axis transverse to the y-axis. A guide rail elongated in the direction of the z-axis may be fastened to the pane for movement with the same. An operating arm is mounted on the support for angular movement about a pivot axis, and its free end is connected to the guide rail for movement of the free end longitudinally of the rail and for arcuate movement with the rail. The pivot axis is inclined relative to a plane defined by the x- and z-axes at a small acute angle $\beta$. The operating arm is turned about the pivot axis by hand or by means of a motor if it is desired to raise or lower the window pane.

Other features, additional objects, and many of the attendant advantages of this invention will readily be appreciated as the same becomes better understood by reference to the following detailed description when considered in connection with the appended drawing in which.

Figure 5:
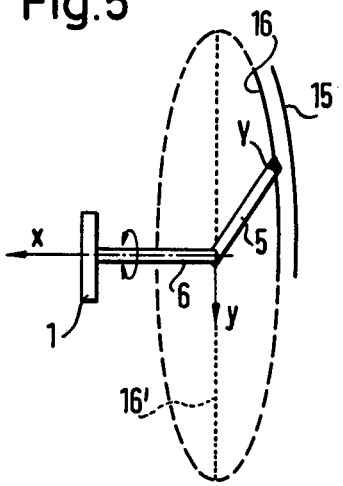
Figure 6:
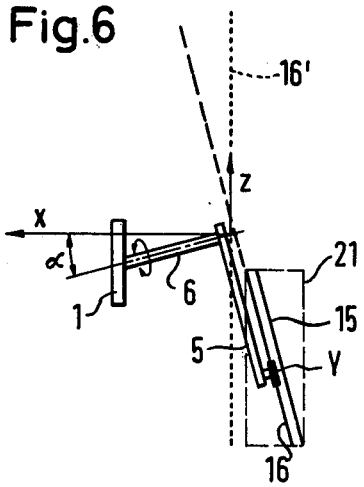

FIG. 5 diagrammatically illustrates elements of a window arrangement and their paths of movement in front elevation;

FIG. 6 shows the elements of FIG. 5 in top plan view; and

Figure 7:
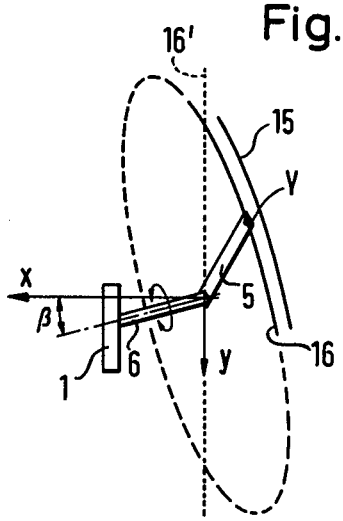

FIG. 7 is a view of a window arrangement of the invention in the manner of FIG. 5.

Figure 1:
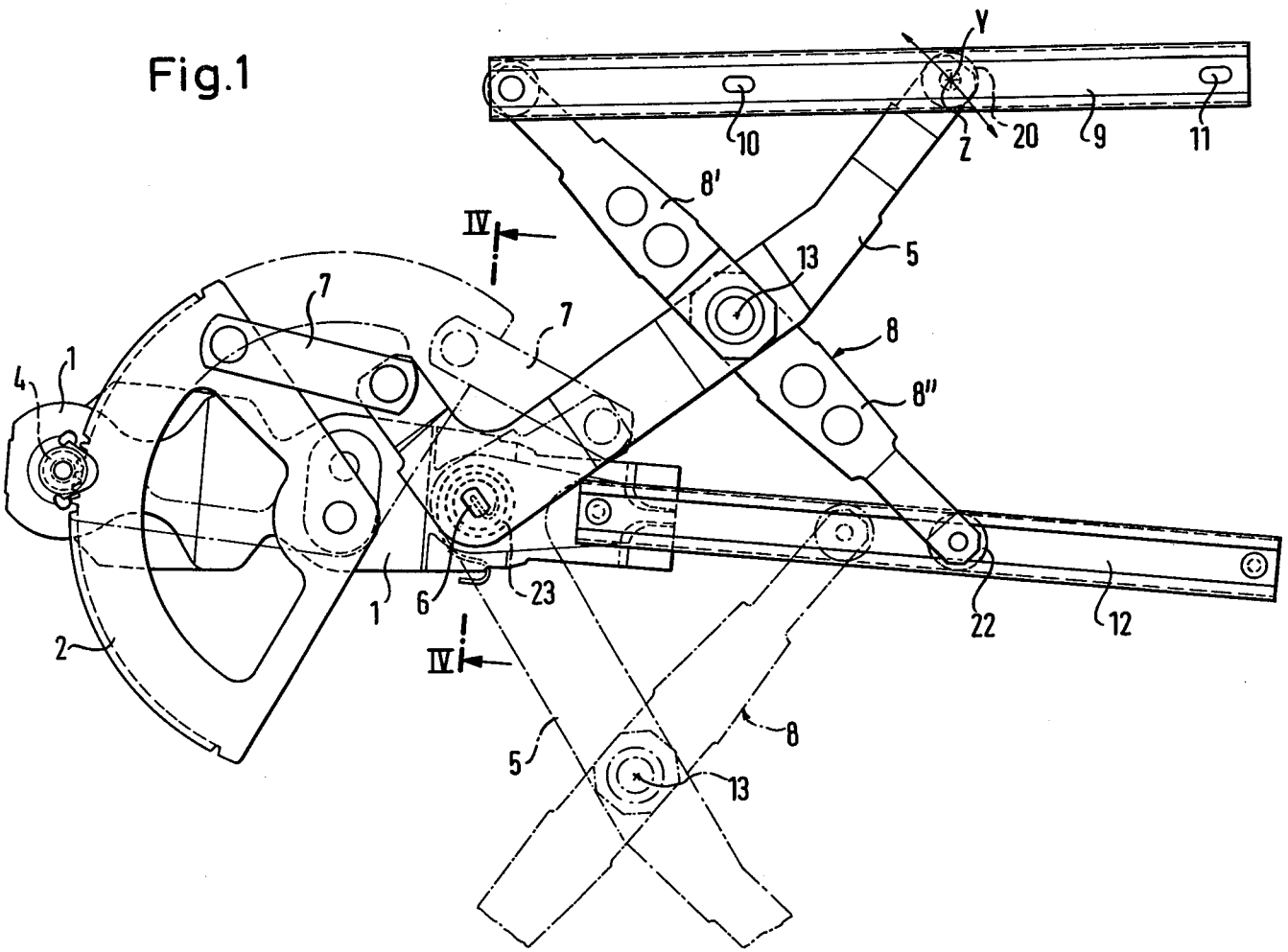
FIG. 1 shows a window lifting arrangement of the invention in fragmentary side elevation.

Referring now to the drawing in detail, and initially to FIG. 1, there is shown only as much of a side door of a passenger car equipped with a window capable of being lowered and raised as is necessary for an understanding of the invention. The normally fixed parts of the door on which the window and lifting mechanism are movably mounted are represented by a base plate 1. A segment gear 2 is journaled in the base plate and may be turned by a pinion 4, also journaled in the plate 1 when the pinion 4 is driven by a manual crank or an electric motor, as is conventional. A window operating lever 5 having one long arm and a much shorter arm is fastened on the base plate 1 by means of a pivot pin 6. A hinged link 7 drivingly connects the segment gear 2 to the short arm of the lever 5.

The long arm of the lever 5 is coupled to a guide arm 8 by a pivot assembly 13 which approximately bisects the long arm and separates two longitudinal sections 8', 8" of the guide arm 8 which are of approximately the same length. A channel-shaped, straight guide rail 9 is provided with elongated mounting holes 10, 11 which permit the guide rail 9 to be fastened to a window pane not itself shown in FIG. 1. A roller 20 on the free end of the lever 5 is confined between the in-turned flanges of the guide rail for longitudinal movement. One end of the guide arm 8 is pivoted to the rail 9. The other end carries a roller 22 longitudinally guided in a guide rail 12 similar to the rail 9 and fixedly mounted on the base plate 1. A spiral spring 23 whose ends are secured to the lever 5 and the base plate 1 respectively is coiled about the pivot pin 6 in such a manner as to bias the lever 5 and associated elements into the fully drawn position, whereas the weight of the window pane, not shown, tends to move the lever 5 and other elements into the position partly indicated in chain-dotted lines.

The structure described so far is sufficiently well known not to require a detailed description of its mode of operation. When the pinion 4 is turned, the guide rail 9 and the non-illustrated window attached thereto are raised and lowered between the two illustrated positions.

For more convenient description of spatial relationships essential to this invention, reference will be had hereinbelow to a system of rectangular coordinates fixed relative to the base plate 1 and other supporting structure of the door. The y-axis of the system is the vertically extending main component of movement of the window pane and of the guide rail 9. The pane and rail move in a shallow arc due to the curvature of the non-illustrated guide grooves receiving the vertically extending edges of the window pane. The z-axis of the system extends approximately in the direction of vehicle movement, and the x-axis is perpendicular to the y- and z-axes.

Figure 3:
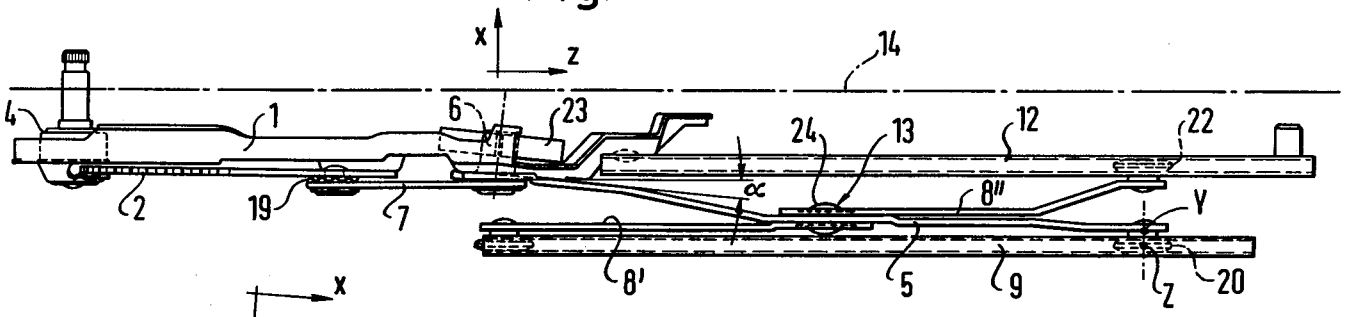
FIG. 3 is a top plan view of the device of FIG. 1.
Figure 4:
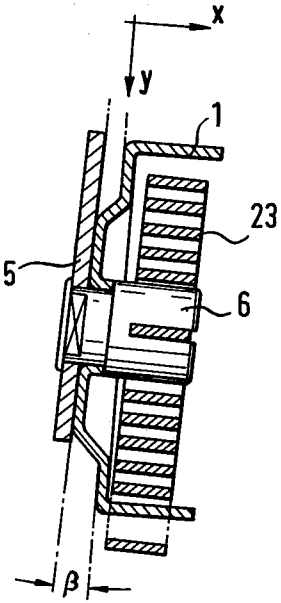
FIG. 4 shows the arrangement of FIG. 1 in enlarged, fragmentary section on the line IV—IV.

As is evident from FIGS. 3 and 4, the base plate 1 extends predominantly in a plane which defines the y- and z-axes, and thereby defines all three axes. A surface 14 of the door panel, indicated in FIG. 3 by a chain-dotted line, bounds the narrow door cavity in which the lifting mechanism is concealed and is also approximately parallel to the plane defined by the y- and z-axes. The link 7 is hinged to the segment 2 by a pin provided with a corrugated spring washer 19 so that the link is capable of limited angular movement relative to the base plate 1 in the x–z plane of FIG. 3. The pivot pin 24 in the pivot assembly 13 may be similarly provided.

The pivot axis of the pin 6 which controls the plane of movement of the lever 5 is inclined relative to the x–y plane of FIG. 4 by a small acute angle $\alpha$ as is evident from FIG. 3 which shows the analogous relationship of planes respectively perpendicular to the x–y plane and to the axis of the pin 6. The pivot axis is inclined relative to the x–z plane of FIG. 3 by another small acute angle $\beta$, as is shown in FIG. 4, for the analogous relationship of the plane y–z and a major surface of the operating lever 5 which is perpendicular to the axis of the pin 6.

The magnitudes of the angle $\alpha$, $\beta$ have been exaggerated in the drawing for greater clarity. The angle $\alpha$ in an actual embodiment of the invention is between 4° and 6°, may range from 3° to 8° without affecting the operation of the mechanism to a significant extent under most circumstances, but should not be outside the range from 1° to 10°. Similarly, the angle $\beta$ should be neither smaller than 0.5° nor larger than 8°, preferably within the range of 1° and 4°, and best between 1.5° and 2.5°.

Figure 2:
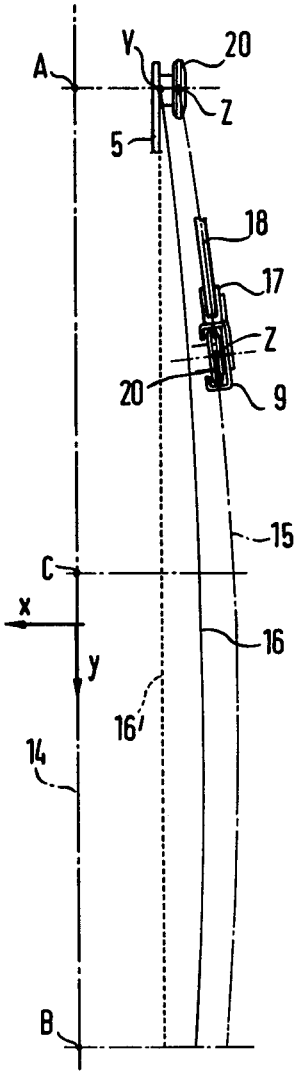
FIG. 2 illustrates elements of the arrangement of FIG. 1 and relevant geometrical relationships in front elevation together with the associated window.

Relevant spatial relationships in the window lifting arrangement are illustrated in FIG. 2. Guides define the path of movement 15 of at least each vertically extending edge of the window pane 18. This path is of necessity circularly arcuate about an axis of curvature parallel to the z-axis, as are the window edges, because any other curvature would cause jamming during raising and lowering of the window. The portion of the window pane between the vertically extending edges may be shaped in any desired manner and may be curved additionally, for example, about a secondary axis of curvature extending in the direction of the y-axis.

The horizontally extending lower edge of the pane 18 is secured in a molding 17 which in turn is fastened to the guide rail 9 by means of screws or like fasteners passing through the mounting holes 10, 11 (FIG. 1). The molding 17 is curved about the afore-mentioned secondary axis if the window pane 18 is so curved, and the guide rail 9 may follow the same curvature, but is preferably straight as is evident from FIG. 3.

The free end of the operating leverl 5 is fastened to the roller 20 at Y. The point Y on the lever 5 moves in a circular path 16 in a plane perpendicular to the pivot axis of the pin 6 if the lever is not bent by forces in the direction of the x-axis which are transmitted by the confined roller 20. The projections of the path 16 in the respective directions of the z- and y-axes shown in FIGS. 2 and 5 to 7 thus are representative of the movements of the point Y when the lever 5 is released from the guide rail 9.

The guide rail 9 moves in a surface 21 which is cylindrically arcuate corresponding to the curvature of the side edges of the pane 18. The center Z of the roller 20 which defines the point of engagement of the lever 5 with the guide rail 9 moves in the path 15 during raising and lowering of the window pane. The curvature of the path 15 corresponds substantially to that of the window pane 18. It therefore appears as a circular arc in the planes of FIGS. 2, 5, and 7. The afore-mentioned cylindrically arcuate surface 21 is generated by a line through the point Z which is longitudinal of the rail 9. The relationship of the surface 21 to the path 15 is represented in FIG. 6 in a simplified manner. When the surface 21 is exactly cylindrical, its projection in the direction of the z-axis coincides with the corresponding projection of the path 15 (see FIGS. 2, 5, and 7).

During the lifting and lowering of the pane 18, the free end of the lever 5 is constrained by the attached roller 20 to follow the movement of the guide rail 9. Let it be assumed, by way of example, that the lever 5 is free from stress transmitted by the rail 9 at point A of its path (FIG. 2), that is, that the position of the free lever end would remain the same if it were released from the roller 20 and thereby from the rail 9. When the window pane 18 is lowered, the lever is subjected to stresses in the direction of the x-axis as the distance between the paths 15, 16 changes. This is due to the fact that the window pane 18 is prevented from significant movement in the direction of the x-axis by its edge guides, represented in FIGS. 2 and 5–7 by the line 15, and any deviation of the paths 15, 16 from parallelism which exceeds the clearances at pertinent connections results in bending of the lever 5 and in correspondingly increased contact pressures at the pivot pin 6, the pivot assembly 13, and the guide rollers 20, 22. Premature wear of the latter would be caused in the absence of the features of this invention presently to be discussed, and window operation would encounter significant resistance for this reason.

The pivot axis for the operating arm is conventional window lifting arrangements of the type described is perpendicular to the major dimensions of the base plate and of the door surface 14 and thus parallel to the x-axis in the system of coordinates shown in the drawing, and the free end of the operating lever in the known devices would move in a circle represented in FIGS. 2 and 5 to 7 by a dotted line 16' if released from the guide rail 9. As is evident from the drawing, the deviation between the free path 16' and the enforced path 15 of the free lever end is relatively great and results in the premature wear and operating difficulties described above.

Because of the afore-described angular relationship of the pivot axis for the lever 5 to the base plate 1 and to the coordinates defined thereby, the paths 15, 16 are almost parallel. Because the axis of the pin 6 deviates from the conventional direction of the x-axis in the horizontal x–z plane by the angle $\alpha$, the path 16 assumes the position represented by an ellipse in the projected view of FIG. 5. When the length of the long arm of the lever 5 and the angle $\alpha$ are suitably correlated the elliptic curve 16 can be adapted closely to the substantially circularly arcuate path 15.

FIG. 5 shows a slightly inclined curve 15 which closely approaches the corresponding upper part of the elliptic curve 16. The pivot axis of the pin 6 is located here in the x–z plane. If the window pane 18, and thus the path 15, are inclined more strongly, as by an additional angle $\beta$, the path 16 can be made to conform to the path 15 in the manner shown in FIG. 7 by suitably inclining the pivot axis by the angle $\beta$ relative to the x–z plane, as is shown in FIG. 7.

FIG. 2 illustrates paths 15, 16 in a preferred embodiment of the invention in which $\alpha=5°$ and $\beta=2°$. The residual small divergence of the paths 15, 16 can be reduced by increasing the magnitudes of the two small acute angles, particularly that of the angle $\alpha$. However, such an increase is limited by the space available in the door cavity in the direction of the x-axis which normally is small (see FIG. 3). The maximum deviation of the curve 16 from the curve 15 evident at C in FIG. 2 is only a fraction of that existing between curves 15 and 16' in the conventional window lifting mechanism, and the resulting stresses and frictional effects in the mechanism of the invention are generally negligible.

As not explicitly illustrated, the link 7 which transmits the driving force of the pinion 4 to the lever 5 moves in a plane perpendicular to the axis of the pin 6. The segment gear 2, however, moves angularly in the y–z plane parallel to the major dimensions (length and width) of the base plate 1. The link 7 thus must move angularly relative to the segment gear 2 during lifting and lowering of the window pane 18. Such movement is permitted by the spring washer 19.

What is claimed is:

1. A window lifting arrangement for raising and lowering a window pane arcuate about an axis of curvature transverse to the principal component of its direction of movement, the arrangement comprising:

(a) a support defining axes x, y, and z of a system of rectangular coordinates;

(b) a guide rail elongated in the direction of the axis z;

(c) fastening means for fastening said guide rail to said window pane for movement therewith in an arc having a principal component in the direction of the axis y;

(d) an operating arm connected to said support for angular movement about a pivot axis and having a free end connected to said guide rail for movement of said free end with said guide rail in said arc, (1) said pivot axis being inclined relative to a plane parallel to the axes x, z at a small acute angle $\beta$ and at a small acute angel $\alpha$ relative to a plane parallel to the axes x, y; and (e) drive means for moving said operating arm about said pivot axis.

2. An arrangement as set forth in claim 1, wherein said support includes a plate member having major dimensions of length and width extending in the direction of said axes z and y respectively, the thickness of said plate member extending in the direction of said axis x.

3. An arrangement as set forth in claim 3, wherein said small acute angles being of a magnitude to cause said free end to move in another arc when released from said guide rail, the median radius of curvature of the projection of said other arc into a plane parallel to said axes x, y being greater than the median radius of curvature of the projection of said one arc into the same plane.

4. An arrangement as set forth in claim 1, wherein the angle $\alpha$ is between 1° and 10°, and the angle $\beta$ is between 0.5° and 8°.

5. An arrangement as set forth in claim 1, wherein the angle $\alpha$ is between 3° and 8°, and the angle $\beta$ is between 1° and 4°.

6. An arrangement as set forth in claim 1, wherein the angle $\alpha$ is between 4° and 6°, and the angle $\beta$ is between 1.5° and 2.5°.

7. An arrangement as set forth in claim 1, wherein said drive means include a segment gear mounted on said support for angular movement about an axis angularly offset from said pivot axis, and a link member hingedly connecting said segment gear to said operating arm.

8. An arrangement as set forth in claim 7, including respective pivots connecting said link member to said segment gear and to said arm, one of said pivots including a spring washer.

* * * * *